US010517327B2

(12) United States Patent
Ewing et al.

(10) Patent No.: US 10,517,327 B2
(45) Date of Patent: Dec. 31, 2019

(54) VAPOR PROVISION SYSTEM AND CARTRIDGE THEREFOR

(71) Applicant: Nicoventures Holdings Limited, London (GB)

(72) Inventors: Mark Patrick Campbell Ewing, London (GB); David Robert Seaward, London (GB); Alexandre Julien Jezequel, London (GB)

(73) Assignee: NICOVENTURES HOLDINGS LIMITED, London (GB)

( * ) Notice: Subject to any disclaimer, the term of this patent is extended or adjusted under 35 U.S.C. 154(b) by 0 days.

(21) Appl. No.: 15/544,694

(22) PCT Filed: Jan. 21, 2016

(86) PCT No.: PCT/GB2016/050126
§ 371 (c)(1),
(2) Date: Jul. 19, 2017

(87) PCT Pub. No.: WO2016/116754
PCT Pub. Date: Jul. 28, 2016

(65) Prior Publication Data

US 2018/0000158 A1 Jan. 4, 2018

(30) Foreign Application Priority Data

Jan. 22, 2015 (GB) ..... 1501060.6

(51) Int. Cl.
*A24F 13/00* (2006.01)
*A24F 47/00* (2006.01)
(Continued)

(52) U.S. Cl.
CPC ..... *A24F 47/008* (2013.01); *F22B 1/284* (2013.01); *H05B 3/42* (2013.01)

(58) Field of Classification Search
CPC ..... A24F 47/008
(Continued)

(56) References Cited

U.S. PATENT DOCUMENTS 2,968,307 A 1/1961 Mazar
3,515,146 A 6/1970 Nealis
(Continued)

FOREIGN PATENT DOCUMENTS

CN 201888252 7/2011
CN 202005248 U 10/2011
(Continued)

OTHER PUBLICATIONS

Notification of Transmittal of the International Preliminary Report on Patentability, International Application No. PCT/GB2016/050126, dated Dec. 22, 2016, 6 pages.
(Continued)

*Primary Examiner* — Phuong K Dinh
(74) *Attorney, Agent, or Firm* — Patterson Thuente Pedersen, P.A.

(57) ABSTRACT

A cartridge for use in a vapor provision system includes an inner container holding a reservoir of fluid to be vaporized, and an outer housing having a mouthpiece formed therein, wherein the outer housing extends in a longitudinal direction along the outside of the inner container for at least a substantial portion of the inner container. The inner container and outer housing are provided with a latch mechanism to retain the inner container within the outer housing.

16 Claims, 9 Drawing Sheets

(51) Int. Cl.
*F22B 1/28* (2006.01)
*H05B 3/42* (2006.01)

(58) Field of Classification Search
USPC ..... 131/328–329
See application file for complete search history.

(56) References Cited

U.S. PATENT DOCUMENTS

| | | | | |
|---|---|---|---|---|
| 4,841,994 | A | 6/1989 | Lugli | |
| 5,470,257 | A | 11/1995 | Szedgda | |
| 8,042,550 | B2 | 10/2011 | Urtsev | |
| 8,511,318 | B2 | 8/2013 | Hon | |
| 8,910,639 | B2 | 12/2014 | Chang | |
| 2003/0150454 | A1 | 8/2003 | Burr | |
| 2009/0014212 | A1* | 1/2009 | Malak | H01R 9/0518 174/75 C |
| 2009/0151717 | A1 | 6/2009 | Dowen | |
| 2011/0011394 | A1 | 1/2011 | Edwards | |
| 2011/0232654 | A1 | 9/2011 | Bernard | |
| 2012/0114809 | A1 | 5/2012 | Edwards | |
| 2012/0312313 | A1 | 12/2012 | Frija | |
| 2012/0318283 | A1 | 12/2012 | Watanabe | |
| 2013/0160779 | A1 | 6/2013 | Chida | |
| 2013/0213420 | A1 | 8/2013 | Hon | |
| 2014/0174441 | A1 | 6/2014 | Seeney | |
| 2015/0305409 | A1* | 10/2015 | Verleur | H02J 7/0022 131/329 |

FOREIGN PATENT DOCUMENTS

| | | | |
|---|---|---|---|
| CN | 202068930 | U | 12/2011 |
| CN | 103720055 | | 4/2014 |
| EA | 201100197 | A1 | 3/2012 |
| EP | 0591178 | B2 | 4/1994 |
| EP | 1946659 | B1 | 7/2008 |
| EP | 1736065 | B1 | 6/2009 |
| EP | 2136660 | B1 | 12/2009 |
| EP | 2168624 | A1 | 3/2010 |
| EP | 2456329 | B1 | 5/2012 |
| RU | 103281 | U1 | 4/2011 |
| WO | WO2007/090594 | | 8/2007 |
| WO | WO2010065744 | A2 | 6/2010 |
| WO | WO2011009920 | A1 | 1/2011 |
| WO | WO2011147691 | A1 | 12/2011 |
| WO | WO2012107414 | A1 | 8/2012 |
| WO | WO2012126242 | A1 | 9/2012 |
| WO | WO2012155058 | A1 | 11/2012 |
| WO | WO2013076098 | A2 | 5/2013 |
| WO | WO2013110208 | A1 | 8/2013 |
| WO | WO 2014028063 | | 2/2014 |
| WO | WO2014060267 | A2 | 4/2014 |
| WO | WO2014150247 | A1 | 9/2014 |
| WO | WO2014207719 | A1 | 12/2014 |

OTHER PUBLICATIONS

Notification of Transmittal of the International Search Report and Written Opinion of the International Searching Authority, International Application No. PCT/GB2016/050126, dated Apr. 12, 2016, 9 pages.
GB Search Report, GB Application No. GB1501060.6, dated Jul. 17, 2015, 4 pages.
Japanese Office Action, Application No. 2017-538605, dated Oct. 2, 2018, 6 pages (12 pages with translation).
Russian Decision to Grant, Application No. 2017125932, dated Jun. 18, 2018, 11 pages.
Chinese Search Report, Application No. 201680066792, dated Mar. 17, 2019 1, page.
Chinese Office Action, Application No. 201680066792, dated Mar. 23, 2019, 18 pages.
European Extended Search Report, Application no. 1916520.0, dated Aug. 2, 2019, 8 pp.

* cited by examiner

VAPOR PROVISION SYSTEM AND CARTRIDGE THEREFOR

CROSS-REFERENCE TO RELATED APPLICATIONS

The present application is a National Phase entry of PCT Application No. PCT/GB2016/050126, filed Jan. 21, 2016, which claims priority from GB Patent Application No. 1501060.6, filed Jan. 22, 2015, each of which is hereby fully incorporated herein by reference.

FIELD

The present disclosure relates to a vapor provision system or device such as an electronic nicotine delivery system (e.g. an e-cigarette), and to a cartridge for use in such a device.

BACKGROUND

Electronic vapor provision systems such as e-cigarettes generally contain a cartridge to provide a reservoir of liquid which is to be vaporized, typically nicotine. When a user inhales on the device, a heater is activated to vaporize a small amount of liquid, which is therefore inhaled by the user. Once the reservoir of liquid has been exhausted, then at least a portion of the device containing the cartridge may be discarded to allow replacement with a new cartridge. Since the cartridge may therefore be a high-volume consumable, it is desirable that it can be produced in a cost-effective manner.

SUMMARY

The disclosure is defined in the appended claims.

A cartridge is provided for use in a vapor provision system includes an inner container holding a reservoir of fluid to be vaporized, and an outer housing having a mouthpiece formed therein, wherein the outer housing extends in a longitudinal direction along the outside of the inner container for at least a substantial portion of the inner container. The inner container and outer housing are provided with a latch mechanism to retain the inner container within the outer housing.

A vapor provision device that includes such a cartridge is also provided. This vapor provision device may be an electronic vapor provision device, such as an e-cigarette.

BRIEF DESCRIPTION OF THE DRAWINGS

FIGS. 3A and 3B are two sections taken in mutually orthogonal first and second planes that both include the longitudinal axis LA of the e-cigarette.

FIG. 5A is a horizontal cross-section through the cartridge (including the longitudinal axis), while FIG. 5B is a view of the inner container by itself (i.e. as removed from inside the outer housing).

FIG. 6A is a horizontal cross-section through the cartridge (including the longitudinal axis), while FIG. 6B is a view of the inner container by itself (i.e. as removed from inside the outer housing).

FIG. 7A is a horizontal cross-section through the cartridge (including the longitudinal axis), while FIG. 7B is a view of the mouth end portion of the inner container by itself (i.e. as removed from inside the outer housing).

FIG. 8A is a horizontal cross-section through the cartridge (including the longitudinal axis), while FIG. 8B is a view of the inner container by itself (i.e. as removed from inside the outer housing).

FIG. 9A is a horizontal cross-section through the cartridge (including the longitudinal axis), FIG. 9B is a view of the outer housing (i.e. without the inner container) sectioned down a vertical plane (including the longitudinal axis), and FIG. 9 is a view of the inner container by itself (i.e. as removed from inside the outer housing).

DETAILED DESCRIPTION

As described above, the present disclosure relates to a vapor provision system, such as an e-cigarette. Throughout the following description the term "e-cigarette" is used; however, this term may be used interchangeably with (electronic) vapor provision system.

Figure 1:
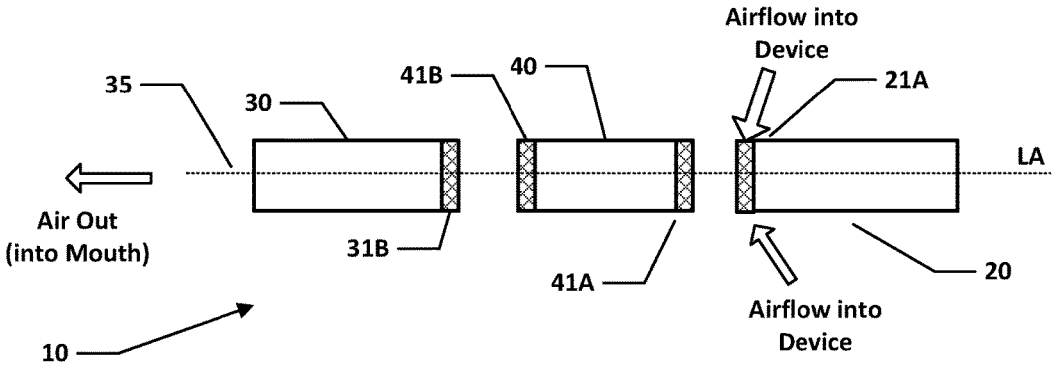
FIG. 1 is a schematic (exploded) diagram of an e-cigarette in accordance with some embodiments of the disclosure.

FIG. 1 is a schematic (exploded) diagram of an e-cigarette 10 in accordance with some embodiments of the disclosure (not to scale). The e-cigarette comprises a body (control unit) 20, a cartridge 30 and a vaporizer 40. The cartridge 30 includes an internal chamber containing a reservoir of liquid and a mouthpiece 35. The liquid in the reservoir typically includes nicotine in an appropriate solvent, and may include further constituents, for example, to aid aerosol formation, and/or for additional flavoring. The cartridge reservoir may include a foam matrix or any other structure for retaining the liquid until such time that it is required to be delivered to the vaporizer. The control unit 20 includes a re-chargeable cell or battery to provide power to the e-cigarette 10 and a circuit board for generally controlling the e-cigarette 10. The vaporizer 40 includes a heater for vaporizing the liquid and further includes a wick or similar device which transports a small amount of liquid from the reservoir in the cartridge 30 to a heating location on or adjacent the heater. When the heater receives power from the battery, as controlled by the circuit board, the heater vaporizes the liquid from the wick and this vapor is then inhaled by a user through the mouthpiece 35.

The control unit 20 and the vaporizer 40 are detachable from one another, but are joined together when the device 10 is in use, for example, by a screw or bayonet fitting (indicated schematically in FIG. 1 as 41A and 21A). The connection between the control unit 20 and the vaporizer 40 provides for mechanical and electrical connectivity between the two. When the control unit 20 is detached from the vaporizer 40, the electrical connection 21A on the control unit 20 that is used to connect to the vaporizer 40 also serves as a socket for connecting a charging device (not shown). The other end of the charging device can be plugged into a USB socket to re-charge the cell in the control unit 20 of the e-cigarette 10. In other implementations, the e-cigarette 10 may be provided with a cable for direction connection between the electrical connection 21A and a USB socket.

The control unit 20 is provided with one or more holes (not shown in FIG. 1) for air inlet. These holes connect to an air passage through the control unit 20 to an air passage provided through the connector 21A. This then links to an air path through the vaporizer 40 and the cartridge 30 to the mouthpiece 35. The cartridge 30 and the vaporizer 40 are attached in use by connectors 41B and 31B (again shown schematically in FIG. 1). As explained above, the cartridge 30 includes a chamber containing a reservoir of liquid, and a mouthpiece 35. When a user inhales through the mouthpiece 35, air is drawn into the control unit 20 through one or more air inlet holes. This airflow (or the resulting change in pressure) is detected by a pressure sensor, which in turn activates the heater to vaporize the liquid from the cartridge 30. The airflow passes from the control unit 20, through the vaporizer 40, where it combines with the vapor, and this combination of airflow and (nicotine) vapor then passes through the cartridge 30 and out of the mouthpiece 35 to be inhaled by a user. The cartridge 30 may be detached from the vaporizer 40 and disposed of when the supply of liquid is exhausted (and then replaced with another cartridge). Note that there is no facility for a user to re-fill the cartridge 30.

The e-cigarette 10 has a longitudinal or cylindrical axis which extends along the center-line of the e-cigarette 10 from the mouthpiece 35 at one end of the cartridge 30 to the opposing end of the control unit 20 (usually referred to as the tip end). This longitudinal axis is indicated in FIG. 1 by the dashed line denoted LA.

It will be appreciated that the e-cigarette 10 shown in FIG. 1 is presented by way of example, and various other implementations can be adopted. For example, in some embodiments, the vaporizer 40 may be integrated into the cartridge 30 as a single unit (sometimes referred to as a cartomizer), and the charging facility may connect to an additional or alternative power source, such as a car cigarette lighter.

Figure 2:
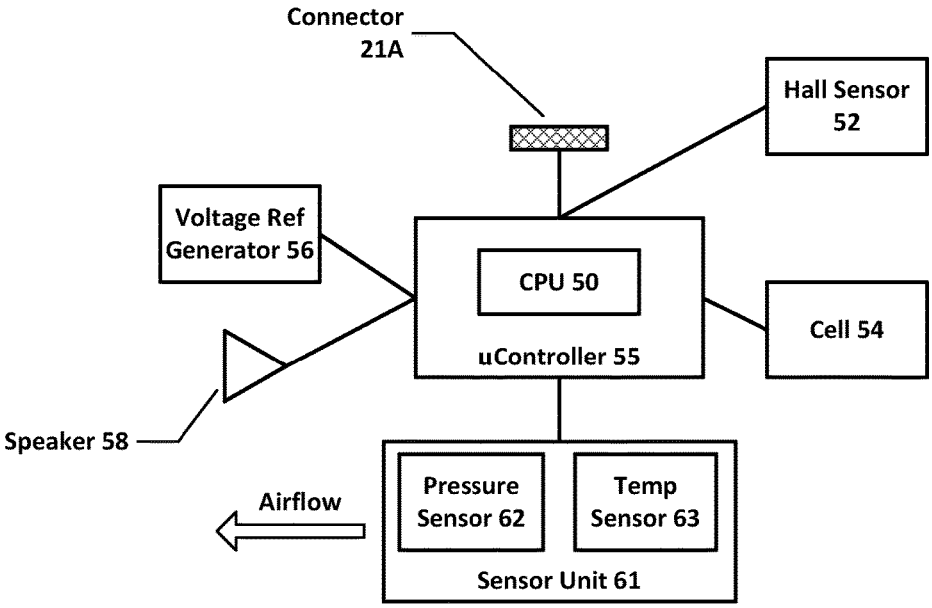
FIG. 2 is a schematic diagram of the main functional components of the body of the e-cigarette of FIG. 1 in accordance with some embodiments of the disclosure.

FIG. 2 is a schematic diagram of the main functional components of the control unit 20 of the e-cigarette 10 of FIG. 1 in accordance with some embodiments of the disclosure. These components may be mounted on the circuit board provided within the control unit 20, although depending on the particular configuration, in some embodiments, one or more of the components may instead be accommodated in the control unit 20 to operate in conjunction with the circuit board, but are not physically mounted on the circuit board itself.

The control unit 20 includes a sensor unit 61 located in or adjacent to the air path through the control unit 20 from the air inlet to the air outlet (to the vaporizer 40). The sensor unit 61 includes a pressure sensor 62 and temperature sensor 63 (also in or adjacent to this air path). The control unit 20 further includes a Hall effect sensor 52, a voltage reference generator 56, a small speaker 58, and an electrical socket or connector 21A for connecting to the vaporizer 40 or to a USB charging device.

The microcontroller 55 includes a CPU 50. The operations of the CPU 50 and other electronic components, such as the pressure sensor 62, are generally controlled at least in part by software programs running on the CPU 50 (or other component). Such software programs may be stored in non-volatile memory, such as ROM, which can be integrated into the microcontroller 55 itself, or provided as a separate component. The CPU 50 may access the ROM to load and execute individual software programs as and when required. The microcontroller 55 also contains appropriate communications interfaces (and control software) for communicating as appropriate with other devices in the control unit 10, such as the pressure sensor 62.

The CPU 50 controls the speaker 58 to produce audio output to reflect conditions or states within the e-cigarette 10, such as a low battery warning. Different signals for signaling different states or conditions may be provided by utilizing tones or beeps of different pitch and/or duration, and/or by providing multiple such beeps or tones.

As noted above, the e-cigarette 10 provides an air path from the air inlet through the e-cigarette 10, past the pressure sensor 62 and the heater (in the vaporizer 40), to the mouthpiece 35. Thus when a user inhales on the mouthpiece 35 of the e-cigarette 10, the CPU 50 detects such inhalation based on information from the pressure sensor 62. In response to such a detection, the CPU 50 supplies power from the battery or cell 54 to the heater, which thereby heats and vaporizes the liquid from the wick for inhalation by the user.

Figures 3A, 3B:
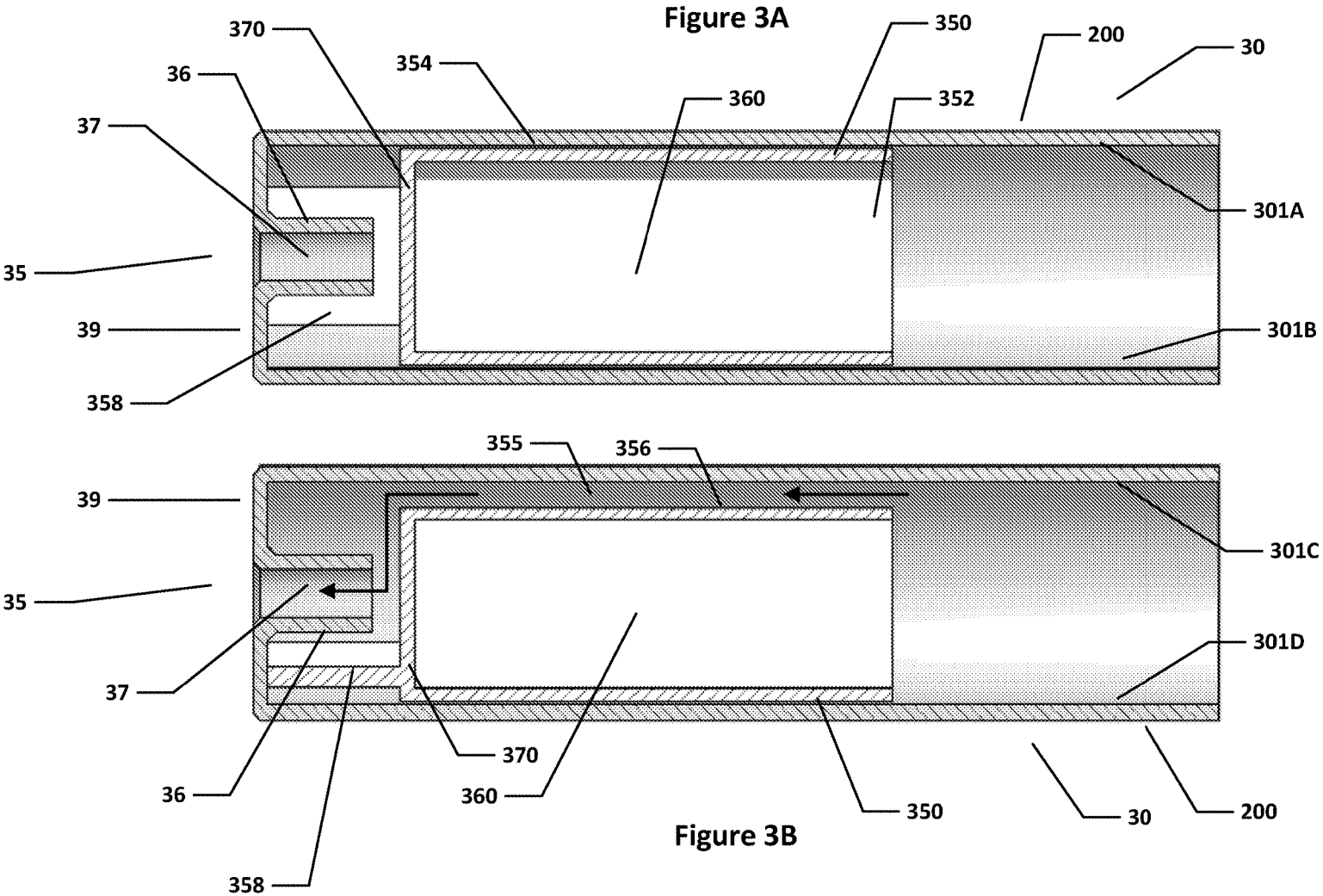
FIGS. 3A and 3B are schematic diagrams of the cartridge portion of an e-cigarette according to an existing design; in particular.
Figure 4:
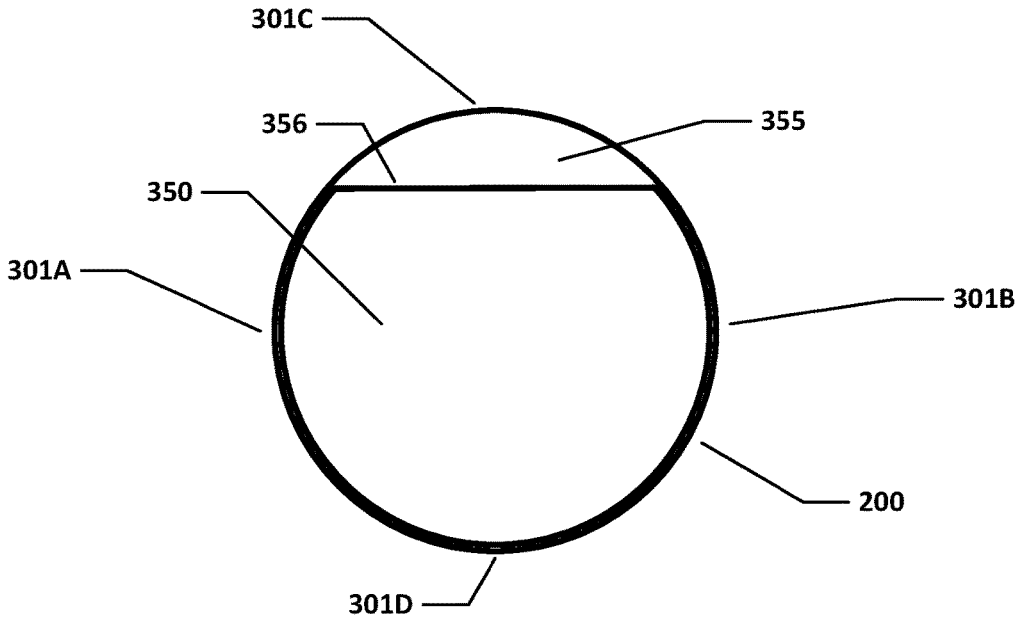
FIG. 4 is schematic diagram of the cartridge portion of the e-cigarette of FIG. 3 according to an existing design and shows a section through the cartridge portion in a plane perpendicular to the longitudinal axis LA, taken approximately halfway along the length of the cartridge portion.

FIGS. 3A and 3B, plus FIG. 4, are schematic diagrams of the cartridge portion 30 of e-cigarette 10 according to an existing design. FIG. 4 shows a section through the cartridge portion 30 in a plane perpendicular to the longitudinal axis LA, taken approximately halfway along the length of the cartridge portion 30. FIGS. 3A and 3B are two sections taken in first and second planes that both include the longitudinal axis LA. These first and second planes are orthogonal to another. For convenience, we will refer to the first plane shown in FIG. 3A as a horizontal plane, and the second plane shown in FIG. 3B as the vertical plane. However, it will be appreciated that although in normal use, the longitudinal axis LA of the e-cigarette 10 is approximately horizontal, a user may typically hold the e-cigarette 10 at any rotational (azimuthal) angle around this longitudinal axis LA. Accordingly, the terms vertical and horizontal are adopted for ease of explanation, rather than particularly implying a given orientation of the device for use.

As shown in FIGS. 3A, 3B and 4, the cartridge 30 contains two main portions: an outer housing 200 and an inner container 350. The outer housing 200 has a generally circular cross-section in a plane perpendicular to the longitudinal axis LA, as can be seen in FIG. 4, thereby forming a generally cylindrical tube. The outer housing 200 has opposing side walls 301A, 301B, plus opposing top and bottom walls 301C and 301D, respectively. (It will be appreciated that these walls 301A-D are generally just different, circumferentially spaced, portions of the tube forming the outer housing 200.)

One end of the outer housing tube, corresponding to the location of the mouthpiece 35, is partly closed by an end wall 39, which is perpendicular to the longitudinal axis LA. An aperture is formed in the center of this end wall, and in particular, an inner tube 37 is formed, which is defined by inner wall 36. This inner wall 36 likewise forms a generally cylindrical tube, parallel to the main outer tube of the outer housing 200 formed by walls 301A-D. However, this inner tube only extends inwards (along the longitudinal axis LA)

a relatively short distance from the radially innermost portion of end wall 39 (compared with the length of the outer tube).

The inner container 350 also has a generally circular cross-section in a plane perpendicular to the longitudinal axis LA, thereby forming a generally cylindrical tube. In particular, the inner container 350 thereby defines a central cavity 360 which retains a reservoir of liquid which is to be vaporized, typically nicotine (in solution). The opening 352 of the inner container 350 at the end opposite to the mouthpiece 35, as shown in FIG. 3A, may be closed with a thin wall, e.g. using metallic foil, to create the sealed chamber. The liquid may be held inside the sealed chamber in a foam matrix. The interior surface of the outer housing 200 may include a screw thread at the end opposite to the mouth end 35 to join to attach the cartridge 30 to the vaporizer portion 40 (see FIG. 1). The attachment may cause a wick on the vaporizer portion 40 to penetrate the cartridge 30 (e.g. by puncturing the seal on the reservoir), thereby drawing liquid from the reservoir onto the vaporizer 40. (Please note that details of the end of the outer housing 200 and the container 350 which are furthest from the mouthpiece 35, including the thin wall or other seal, and the configuration of the wick, etc, are omitted for clarity from FIGS. 3A and 3B.)

The horizontal side walls of the inner container 350 abut against the corresponding side walls 301A, 301B of the outer housing 200. In particular, there is an interference fit between the horizontal side walls of the inner container 350 and the corresponding side walls 301A, 301B of the outer housing 200, which is used to retain the inner container 350 within the outer housing 200. A portion of this interference fit is denoted by reference numeral 354 in FIG. 3A, and is formed between the side wall 301A of the outer housing 200 and the corresponding side wall of the inner container 350. Note that in practice there is a slight taper on the outer housing 200 (not shown in FIG. 3) in order to enable molding and to support this interference fit—i.e. the outer housing 200 tapers slightly inwards so as to be narrower at the mouth end 35.

The generally cylindrical tube of the inner container 350 is closed at the mouthpiece end 35 by wall 370. In addition, the interference fit between the side wall 301A of the outer housing 200 and the corresponding side wall of the inner container 350 generally prevents the flow of air along the e-cigarette 10. Accordingly, although the inner container 350 has a generally circular cross-section in a plane perpendicular to the longitudinal axis LA, the top-most portion of this circle is flattened to allow airflow through the e-cigarette 10.

In particular, the top wall 356 of the inner container 350 is formed (in the cross-section of FIG. 4) by a chord, rather than by an arc. This therefore defines an air passage 355 between the top wall 301C of the outer housing 200 and the top wall 356 of the inner container 350. This air passage 355 is also shown in FIG. 3B, together with arrows denoting the airflow from the vaporizer portion 40 out through the mouthpiece 35.

The end wall 370 of the inner container 350 which is adjacent the mouthpiece 35 is provided with a tab 358. This tab 358 extends in a direction parallel to the longitudinal axis LA of the e-cigarette 10 to abut against the end wall 39 of the outer housing 200. The tab 358 has a cross-section of an arc in a plane perpendicular to the longitudinal axis LA of the e-cigarette 10, and is located at the bottom of the inner container 350, i.e. opposite to the top wall 356. In this position, the tab 358 does not block the airflow from the passage 355 out through the mouthpiece 35.

In addition, the length of the tab 358 (in a direction parallel to the longitudinal axis LA) is greater than the length of the inner wall 36 which defines the mouthpiece tube 37. Consequently, the tab 358 serves to prevent the end wall 370 abutting against (and thereby closing) the inside end of the mouthpiece tube 37. This configuration therefore again helps to ensure that air flowing through the air passage 355 can then reach the mouthpiece tube 37 in order to exit through the mouthpiece 35.

While the cartridge 30 according to the existing design, as shown in FIGS. 3A, 3B and 4, is functional, this design places strict tolerances on the relative sizing of the inner container 350 relative to the outer housing 200 in order to ensure that the interference fit 354 can be successfully achieved. Thus if the outer housing 200 is too large relative to the inner container 350, the inner container 350 may become dislodged from its correct positioning in the cartridge 30. Conversely, if the outer housing 200 is too small relative to the inner container 350, then it may not be possible to insert the inner container 350 into the outer housing 200. The strict tolerances on the relative sizing of the inner container 350 relative to the outer housing 200 can increase manufacturing costs and/or cause product reliability issues.

In order to address the above concerns, a cartridge 30 has been developed in which the inner container 350 and outer housing 200 are latched together by a resilient latching mechanism. It will be appreciated that at least one of the inner container 350 and/or outer housing 200 is usually made of plastic, which typically provides sufficient flexibility or resilience to support such a latching mechanism.

FIGS. 5-10 illustrate various different implementations of the latching mechanism 500. These implementations can be considered as modifications of the cartridge 30 described with respect to FIGS. 3 and 4. Thus in the discussion of FIGS. 5-10, aspects of these implementations which are generally unchanged from the cartridge 30 already described with respect to FIGS. 3 and 4 will not be described again in order to avoid repetition. Furthermore, it will be appreciated that the various implementations of FIGS. 5-10 are not intended to be exhaustive—rather the skilled person will be aware of various possible further implementations. In addition, the various implementations of FIGS. 5-10 are not intended to be mutually exclusive, in that one or more features from different implementations may be combined as appropriate to create new implementations.

Figure 5A:
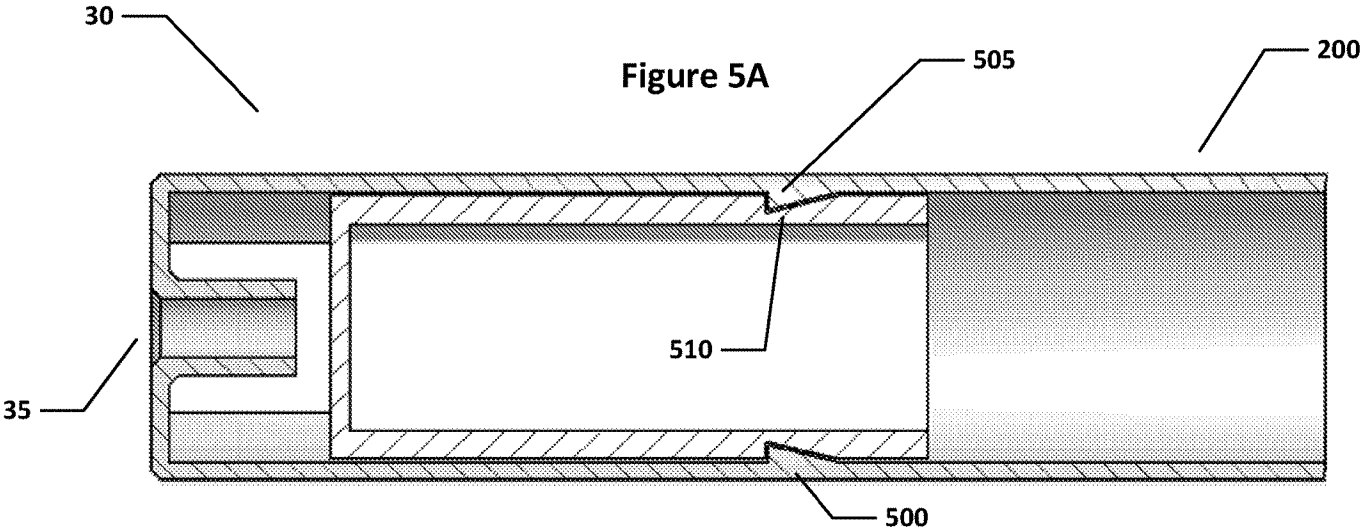
FIGS. 5A and 5B illustrate one implementation of the cartridge for an e-cigarette in accordance with some embodiments of the disclosure, where
Figure 5B:
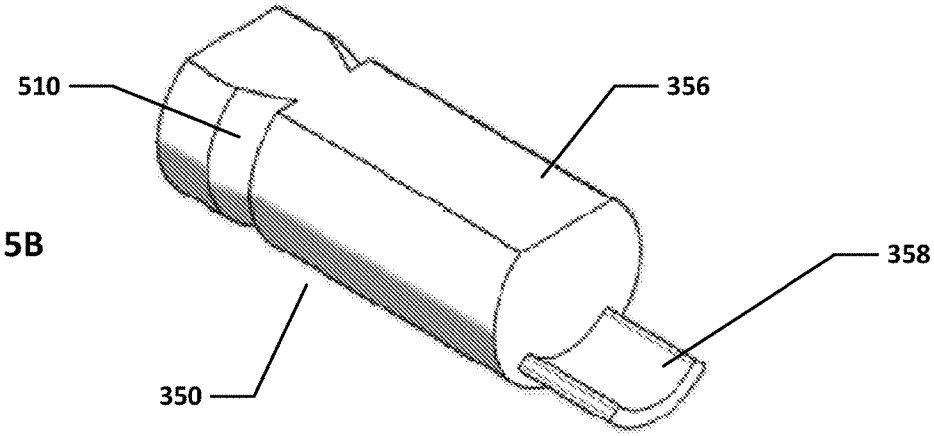

FIGS. 5A and 5B illustrate one implementation of the cartridge 30 which again comprises an outer housing 200 and an inner container 350. In particular, FIG. 5A is a horizontal cross-section through the cartridge 30 (including the longitudinal axis LA), while FIG. 5B is a view of the inner container 350 by itself (i.e. as removed from inside the outer housing 200).

The implementation of FIGS. 5A and 5B differs from the cartridge of FIGS. 3A, 3B and 4 by the inclusion of a latching mechanism 500. This latching mechanism 500 is formed by the provision of a groove 510 formed in the inner container 350 and a corresponding protrusion 505 formed on the inside of the outer housing 200. As can be seen in FIG. 5B, the groove 510 extends around the circumference of the inner container 350 (with respect to the longitudinal axis LA), except that the groove 510 does not extend across the top wall 356. The groove 510 has a shape somewhat analogous to the numeral "7" and is formed by two sides. The first side is located furthest from the mouthpiece 35 and has a relative shallow angle or gradient with respect to the longitudinal axis LA, and with respect to the external cylindrical surface of the inner container 350. The second side is located closer to the mouthpiece 35 and has a much steeper (potentially perpendicular) angle or gradient with respect to the longitudinal axis LA.

The protrusion 505 formed on the inside of the outer housing 200 has a complementary shape to the groove 510. In particular, the protrusion 505 extends around the circumference of the inner wall of the outer housing 200. However, the protrusion 505 does not extend across the top wall 301C of the outer housing 200 in order not to obstruct the air passage 355. The protrusion 505 also has a shape somewhat analogous to the numeral "7" (in order to match the groove 510) and is formed by two sides. The first side is located furthest from the mouthpiece 35 and has a relative shallow angle or gradient with respect to the longitudinal axis LA, and with respect to the internal cylindrical surface of the outer housing 200. The second side is located closer to the mouthpiece 35 and has a much steeper (potentially perpendicular) angle or gradient with respect to the longitudinal axis LA.

It will be appreciated that once the inner container 350 has been inserted into the outer housing 200 as per the implementation shown in FIG. 5, the steep second side of the protrusion 505 abuts against the steep second side of the groove 510. This abutment prevents movement between the inner container 350 and the outer housing 200 along the longitudinal axis LA, especially in a direction that would tend to move the inner container 350 towards the end of the outer housing 200 furthest from the mouthpiece 35.

Figure 6A:
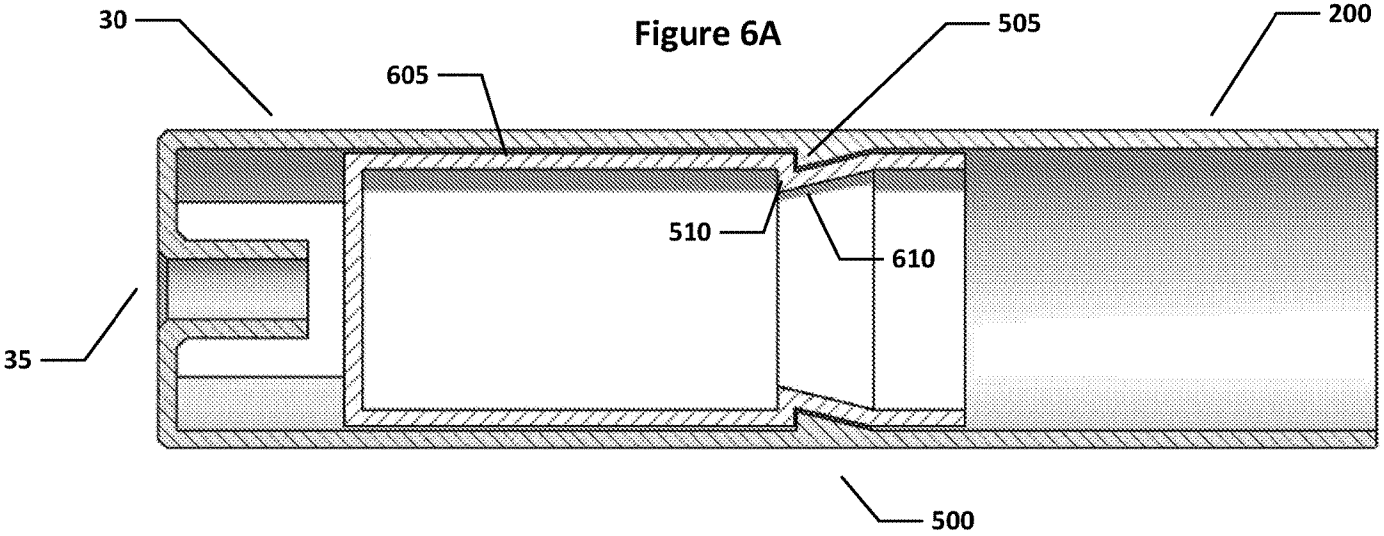
FIGS. 6A and 6B illustrate one implementation of the cartridge for an e-cigarette in accordance with some embodiments of the disclosure, where
Figure 6B:
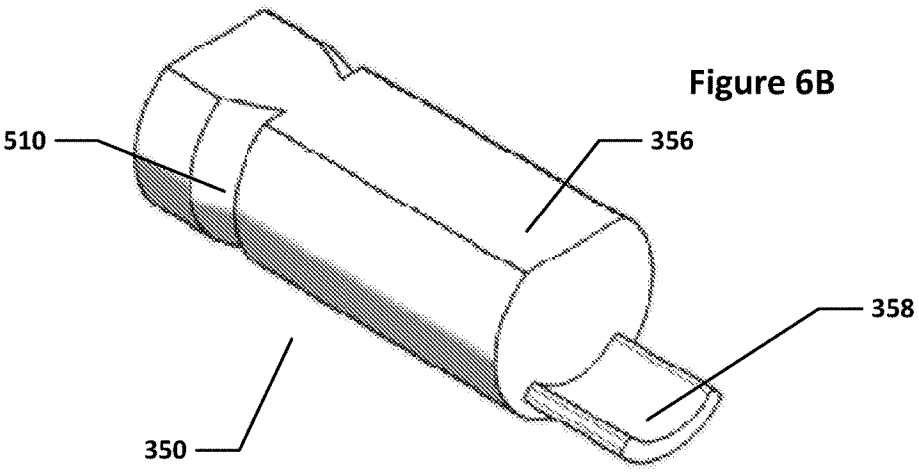

FIGS. 6A and 6B illustrate another implementation of the cartridge 30 which again comprises an outer housing 200 and an inner container 350. In particular, FIG. 6A is a horizontal cross-section through the cartridge 30 (including the longitudinal axis LA), while FIG. 6B is a view of the inner container 350 by itself (i.e. as removed from inside the outer housing 200).

The implementation of FIGS. 6A and 6B is similar to the implementation of FIGS. 5A and 5B. The difference is that in the implementation of FIGS. 5A and 5B, the internal face of wall of the inner container 350 was flat along the longitudinal length of the cartridge 30. Consequently, the portion of the wall of the inner container 350 where the groove 510 is formed is thinner, and hence potentially weaker, than the remainder of this wall. In the implementation of FIGS. 6A and 6B however, the wall 605 of the inner container 350 in effect has an approximately constant thickness. This means that the indentation of the groove 510 is mirrored by corresponding indentation 610 of the wall 605 of the inner container 350 into the internal volume of the inner container 350.

It will be appreciated that the operation of the latching mechanism 500 in the implementation of FIGS. 6A and 6B is substantially similar to the operation of the latching mechanism 500 in the implementation of FIGS. 5A and 5B. However, the implementation of FIGS. 6A and 6B avoids having a reduced thickness for the wall 605 of the inner container 350, which may be important for some situations.

Figure 7A:
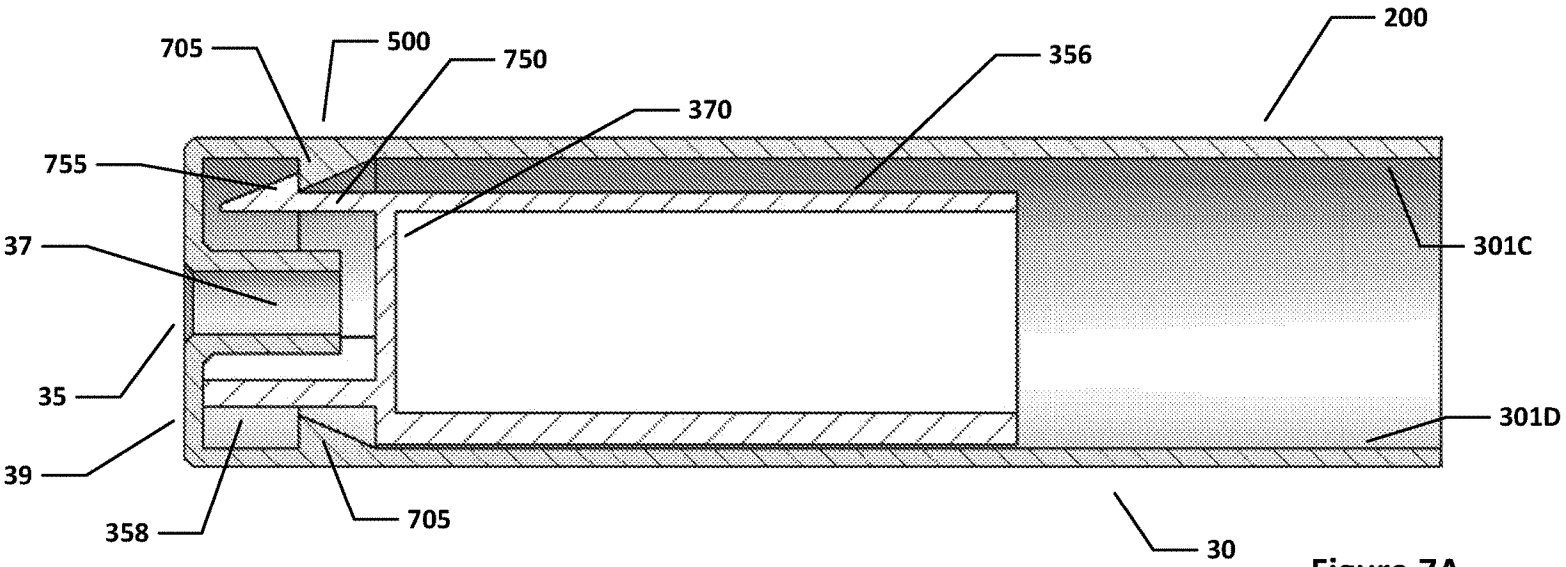
FIGS. 7A and 7B illustrate one implementation of the cartridge for an e-cigarette in accordance with some embodiments of the disclosure, where
Figure 7B:
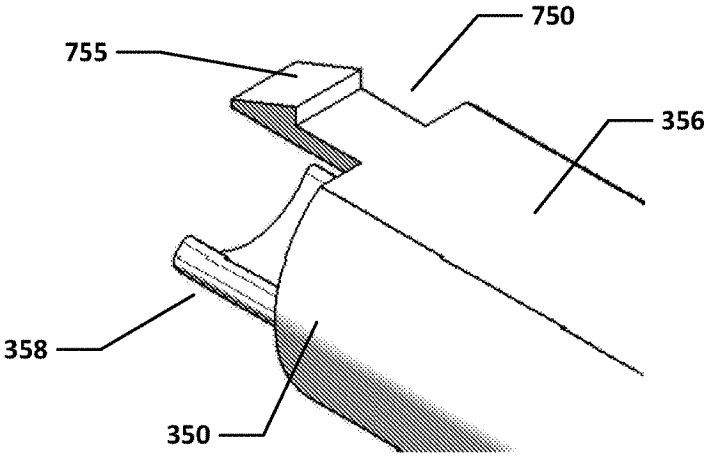

FIGS. 7A and 7B illustrate another implementation of the cartridge 30 which again comprises an outer housing 200 and an inner container 350. In particular, FIG. 7A is a vertical cross-section through the cartridge 30 (including the longitudinal axis LA), while FIG. 7B is a view of the inner container 350 by itself (i.e. as removed from inside the outer housing 200), in particular the portion adjacent the mouth end 35.

In the implementation of FIGS. 7A and 7B, the outer housing 200 is generally the same as for the implementation of FIGS. 3A, 3B and 4, except for the addition of a protrusion 705. This protrusion 705 is located near the mouthpiece end 35 of the outer housing 200, in particular, between the end wall 370 of the inner container and the end wall 39 of the outer housing 200. The protrusion 705 is directly radially inward and is formed all around the inner circumference of the outer housing 200, i.e. it spans azimuth angles form 0 to 360 degrees with respect to the longitudinal axis LA.

The protrusion 705 again has a shape somewhat analogous to the numeral "7", and is formed by two sides. The first side (a ramp portion) is located furthest from the mouthpiece end 35 and has a relative shallow angle or gradient with respect to the longitudinal axis LA, and also with respect to the internal cylindrical surface of the outer housing 200. The second side (a catch portion) is located closer to the mouthpiece 35 and has a much steeper (potentially perpendicular) angle or gradient with respect to the longitudinal axis LA.

In the implementation of FIGS. 7A and 7B, the inner container 350 is generally the same as for the implementation of FIGS. 3A, 3B and 4, except for the addition of a second tab 750. This second tab 750 is like the first tab, in that it extends from wall 370 towards the mouthpiece end 35. However, the second tab 750 is somewhat shorter than the first tab 358, so that it does not reach the end wall 39 of the outer housing 200. In addition, the second tab 750 extends from the top wall 356 of the inner container 350, and is therefore diametrically opposed (having regard to the longitudinal axis LA) to the first tab 358, which extends from close to the bottom of the inner container 350.

The second tab 750 is also shaped differently from the first tab 358. Thus the second tab 750 comprises a first portion, which is flat and attached to the end wall 370. This flat portion can in effect be considered as an extension of the top wall 356. The flat portion also supports, in cantilever fashion a raised portion 755. This raised portion 755 interacts with the protrusion 705 of the outer housing 200 to form the latching mechanism 500. Note however that the protrusion 705 of the outer housing 200 is sized so as not to obstruct the first tab 358, which can pass radially inward of the protrusion 705.

The raised portion 755 again has a shape somewhat analogous to the numeral "7", and is formed by two sides. The first side is located furthest from the end wall 370 and has a relative shallow angle or gradient with respect to the longitudinal axis LA, and also with respect to the top wall 356 of the inner container 350. The second side is located closer to the mouthpiece 35 and has a much steeper (potentially perpendicular) angle or gradient with respect to the longitudinal axis LA.

It can be seen that in operation, as the inner container 350 is inserted into the outer housing 200, the raised portion 755 of the second tab 750 makes contact with the inward protrusion 705 of the outer container 200. This causes the second tab 750 to flex slightly in a radially inward (downward) direction, thereby allowing the raised portion 755 to slide past (and against) the inward protrusion 705.

Eventually, when the inner container 350 is fully inserted, as shown in FIG. 7A, the corner of the protrusion 705 (i.e. where the shallow side meets the steep side) goes past the corner of the raised portion 755 (again where the shallow side meets the steep side). This allows the second tab 750 to flex resiliently back upwards to the position shown in FIG. 7A. In this configuration, the steep side of the protrusion 705, which faces in the direction of the mouth end 35, abuts against the steep side of the raised portion 755 of the second tab 750, which faces in the opposite direction (away from the mouth end 35). These two sides abut against one another to provide a latching action for latch mechanism 500, and thereby prevent withdrawal of the inner container 350 from the outer housing 200.

Note that the circumferential (azimuthal) extent, i.e. the rotational angle subtended with respect to the longitudinal axis LA, is smaller for the second tab 750 than for the first tab 358. In addition, the rotational angle subtended with respect to the longitudinal axis LA, is smaller for the second tab 750 than for the top wall 356 of the inner container 350. This ensures that air flowing along the passage 355 (see FIG. 3B) is able to flow around the second tab 750, i.e. on either side of it, in order to progress to the mouthpiece hole 37 and then out of the e-cigarette 10.

One particular advantage of the implementation shown in FIGS. 7A and 7B is that for inserting the inner container 350 into the outer housing 200, the two longitudinal axes for these two components must be mutually aligned (i.e. coincident). However, there is no need to rotationally align the inner container 350 relative to the outer housing 200 about the longitudinal axis LA, since the inward protrusion 705 of the outer housing 200 spans a rotational angle of 360 degrees. Accordingly, the second tab 750 will engage with the inward protrusion 705 irrespective of the relative rotational angle of insertion between the outer housing 200 and the inner container 350. This therefore avoids the need to perform a rotational alignment between these two components prior to insertion of the inner container 350 into the outer housing 200, which can help to reduce manufacturing complexity (and hence costs).

The embodiment of FIGS. 7A and 7B again avoids having a groove portion formed in the inner container 350, thereby avoiding any potential weakness. In addition, unlike the embodiment of FIG. 6, the internal shape of the inner container 350 is unchanged. This may help to retain the maximum volume of the inner container 350, as well as avoiding any potential difficulties with the filling process.

Figure 8A:
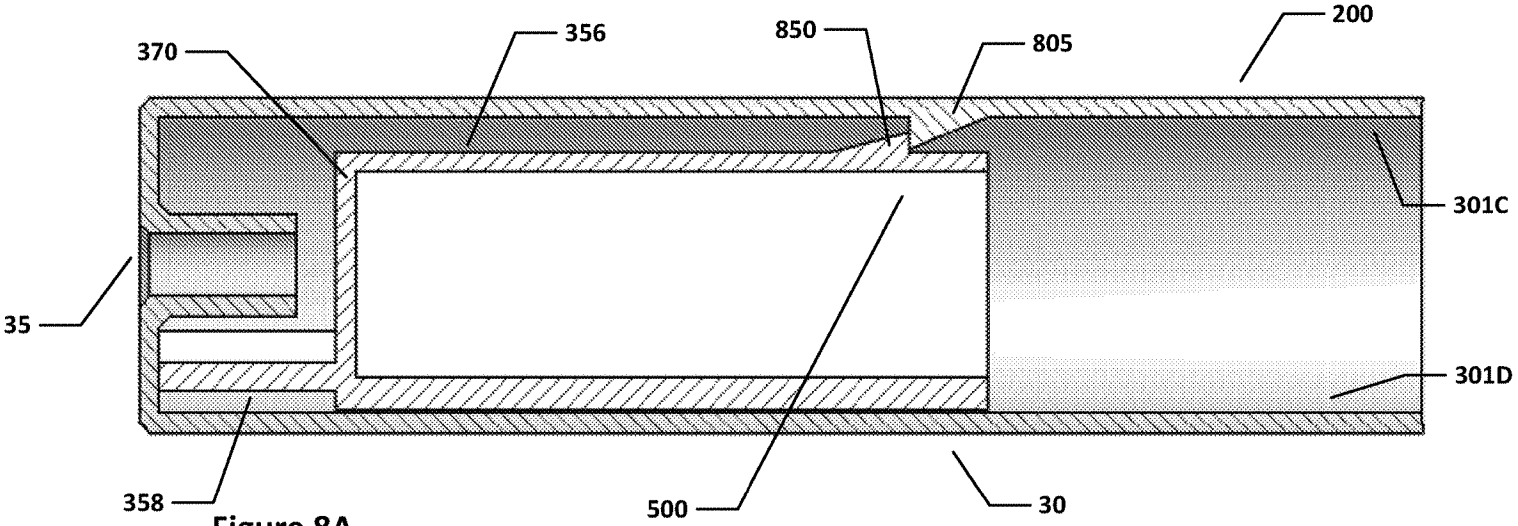
FIGS. 8A and 8B illustrate one implementation of the cartridge for an e-cigarette in accordance with some embodiments of the disclosure, where
Figure 8B:
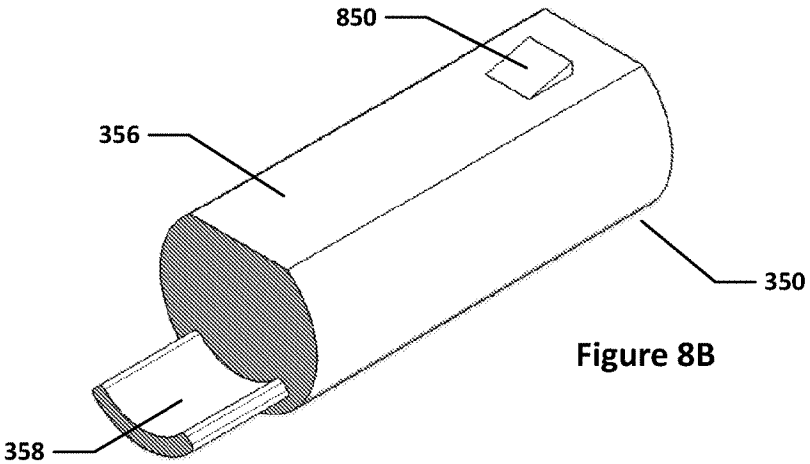

FIGS. 8A and 8B illustrate another implementation of the cartridge 30 which again comprises an outer housing 200 and an inner container 350. In particular, FIG. 8A is a vertical cross-section through the cartridge 30 (including the longitudinal axis LA), while FIG. 8B is a view of the inner container 350 by itself (i.e. as removed from inside the outer housing 200).

In the implementation of FIGS. 8A and 8B, the outer housing 200 is generally the same as for the implementation of FIGS. 3A, 3B and 4, except for the addition of a protrusion 805. This protrusion 805 is generally similar to the protrusion 705 in the implementation of FIGS. 7A and 7B, except for its location. Thus the protrusion 805 is not near the mouth end 35, but rather is located so as to be near the end of the inner container 350 furthest from the mouth end 35 (when the inner container 350 has been fully inserted into the outer housing 200).

The protrusion 805 is directly radially inward and again has a shape somewhat analogous to the numeral "7", and is formed by two sides. The first side (a ramp portion) is located furthest from the mouthpiece end 35 and has a relative shallow angle or gradient with respect to the longitudinal axis LA, and also with respect to the internal cylindrical surface of the outer housing 200. The second side (a catch portion) is located closer to the mouthpiece 35 and has a much steeper (potentially perpendicular) angle or gradient with respect to the longitudinal axis LA.

In the implementation of FIGS. 8A and 8B, the inner container 350 is generally the same as for the implementation of FIGS. 3A, 3B and 4, except for the addition of a protrusion 850 formed on the top wall 356 of the inner container 350 and directed radially outward. The protrusion 850 again has a shape somewhat analogous to the numeral "7", and is formed by two sides. The first side is located closest to the end wall 370 and has a relative shallow angle or gradient (ramp portion) with respect to the longitudinal axis LA, and also with respect to the top wall 356 of the inner container 350. The second side is located further from the end wall 370 and has a much steeper (potentially perpendicular) angle or gradient with respect to the longitudinal axis LA.

In operation, as the inner container 350 is inserted into the outer housing 200, the ramp portion of the protrusion 850 on the inner container 350 makes contact with the corresponding ramp portion of the inward protrusion 805 of the outer container. Eventually, when the inner container is fully inserted, as shown in FIG. 8A, the steep side of the protrusion 805, which faces in the direction of the mouth end 35, abuts against the steep side of the inner container protrusion 850, which faces in the opposite direction (away from the mouth end). These two sides abut against one another to provide a latching action for latch mechanism 500, and thereby prevent withdrawal of the inner container 350 from the outer housing 200.

Note that the width of the protrusion 850 on the top wall 356 of the inner container 350 is less than the width of the top wall 356. This ensures that air flowing along the passage 355 (see FIG. 3B) is able to flow around the protrusion 850, i.e. on either side of it, in order to progress to the mouthpiece hole 37 and then out of the e-cigarette 10.

Figure 9A:
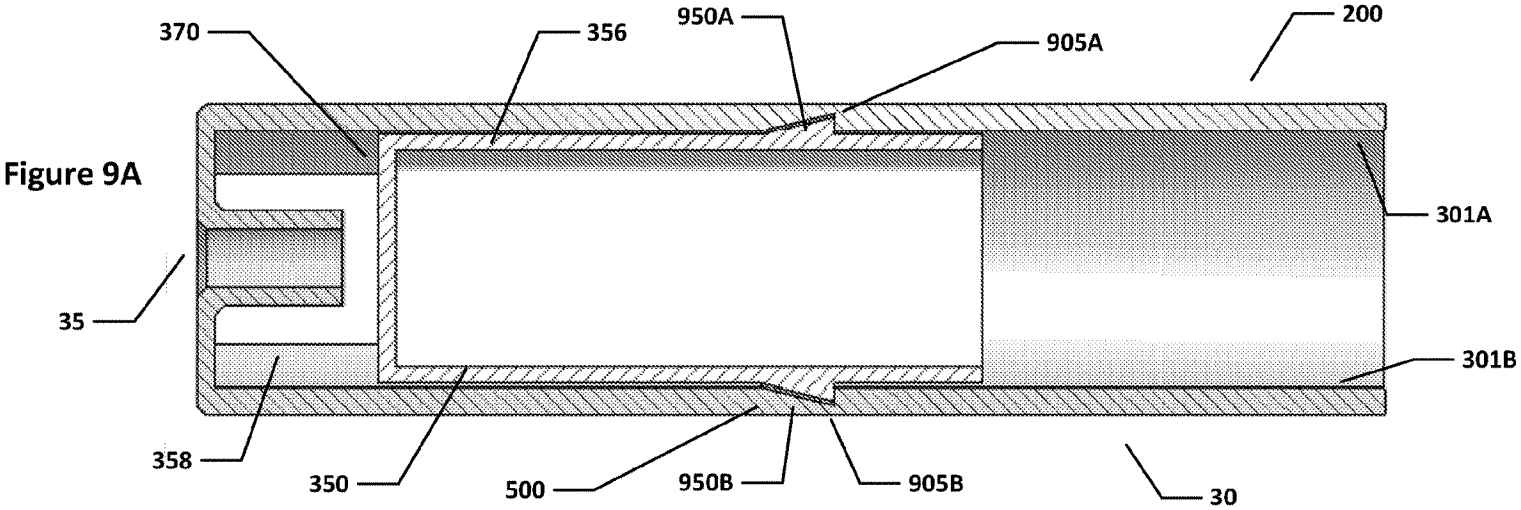
FIGS. 9A, 9B and 9CB illustrate one implementation of the cartridge for an e-cigarette in accordance with some embodiments of the disclosure, where
Figure 9C:
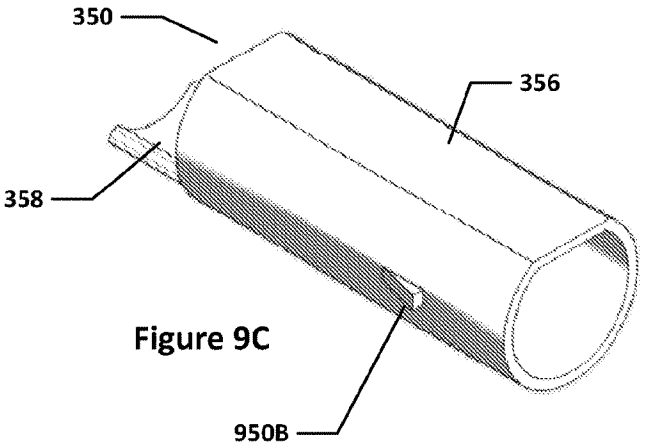
Figure 9B:
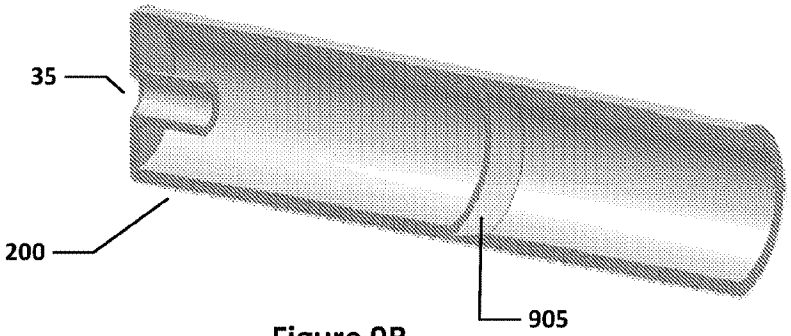

FIGS. 9A, 9B and 9C illustrate another implementation of the cartridge 30 which again comprises an outer housing 200 and an inner container 350. In particular, FIG. 9A is a horizontal cross-section through the cartridge 30 (including the longitudinal axis LA), FIG. 9B is a view of the outer housing 200 (without the inner container 350) which has been split down a vertical plane, and FIG. 9C is a view of the inner container 350 by itself (i.e. as removed from inside the outer housing 200).

In the implementation of FIGS. 9A-9C, the outer housing 200 is generally the same as for the implementation of FIGS. 3A, 3B and 4, except for the addition of a circumferential groove 905 in the inner wall of the outer housing 200. More particularly, the groove 905 is formed all around the inner circumference of the outer housing 200, i.e. it spans azimuth angles form 0 to 360 degrees with respect to the longitudinal axis LA. The groove 905 again has a shape somewhat analogous to the numeral "7", and is formed by two sides. The first side (a ramp portion) is located furthest from the mouthpiece end 35 and has a relative shallow angle or gradient with respect to the longitudinal axis LA, and also with respect to the internal cylindrical surface of the outer housing 200. The second side (a catch portion) is located closer to the mouthpiece 35 and has a much steeper (potentially perpendicular) angle or gradient with respect to the longitudinal axis LA.

In the implementation of FIGS. 9A-9C, the inner container 350 is generally the same as for the implementation of FIGS. 3A, 3B and 4, except for the addition of a protrusion 950A, 950B formed on each side wall of the inner container 350 and directed radially outward. The protrusions 950A, 950B again have a shape somewhat analogous to the numeral "7", and are each formed by two sides. The first side is located closest to the end wall 370 and has a relative shallow angle or gradient (ramp portion) with respect to the longitudinal axis LA. The second side is located further from the end wall 370 and has a much steeper (potentially perpendicular) angle or gradient with respect to the longitudinal axis LA.

In operation, as the inner container 350 is inserted into the outer housing 200, the ramp portion of the protrusions 950A, 950B on the inner container 350 make contact with the corresponding inner wall of the outer container 200, which therefore flexes outwards a little. Eventually, when the inner container 350 is fully inserted, as shown in FIG. 9A, the steep sides of the protrusions 950A, 950B, which face in a direction away from the mouth end 35, abut against the steep side of the groove 905, which faces in the opposite direction (towards the mouth end). These two sides abut against one another at groove locations 905A, 905B to provide a latching action for latch mechanism 500, and thereby prevent withdrawal of the inner container 350 from the outer housing 200.

One particular advantage of the implementation shown in FIGS. 9A-9C is again there is no need to rotationally align the inner container 350 relative to the outer housing 200 about the longitudinal axis LA, since the inward groove 905 of the outer housing 200 spans a rotational angle of 360 degrees. Accordingly, the groove 905 of the outer housing 200 will engage with the protrusions 950A, 950B of the inner container 350 irrespective of the relative rotational angle of insertion between the outer housing 200 and the inner container 350. This therefore avoids the need to perform a rotational alignment between these two components prior to insertion of the inner container 350 into the outer housing 200, which can help to reduce manufacturing complexity (and hence costs).

Figure 10:
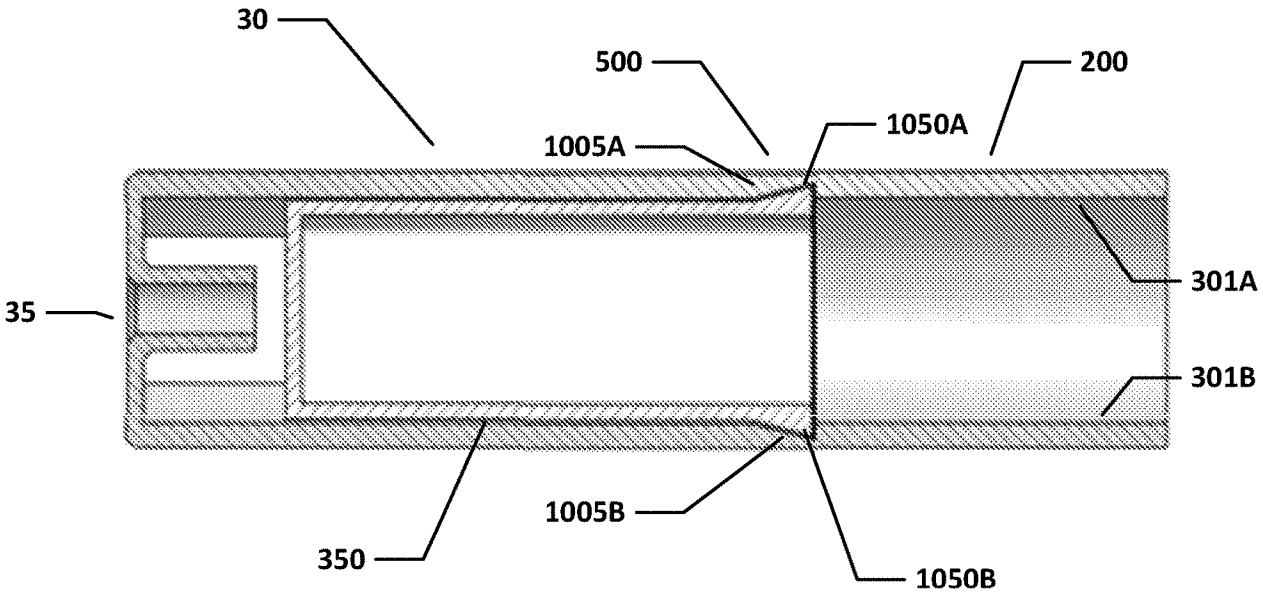
FIG. 10 illustrate one implementation of the cartridge for an e-cigarette in accordance with some embodiments of the disclosure, showing a horizontal cross-section through the cartridge (including the longitudinal axis).

FIG. 10 illustrates another implementation of the cartridge 30 which again comprises an outer housing 200 and an inner container 350. In particular, FIG. 10 is a horizontal cross-section through the cartridge 30 (including the longitudinal axis LA). The implementation of FIG. 10 is generally the same as the implementation of FIGS. 9A-9C, in that has a circumferential groove 1005 is formed on the interior cylindrical wall of the outer housing 200, and this forms a latching mechanism 500 with two corresponding protrusions 1050A, 1050B on respective sides of the inner container 350.

The implementation of FIG. 10 differs from the implementation of FIGS. 9A-9C as regards the positioning of the circumferential groove 1005 along the longitudinal axis LA, and hence the corresponding positioning of the protrusions 1050A, 1050B. In particular, the protrusions 1050A, 1050B are now located at the end of the inner container 350 furthest from the mouth end 35 (analogous to tail fins). This positioning may provide certain advantages. For example, the flexing of the outer housing 200 to accommodate the protrusions 1050A, 1050B as the inner container 350 is inserted into the outer housing 200 prior to engagement of the latching mechanism 500 occurs further away from the end wall 39 and mouth end 35 and nearer to the (opposite) open end of the outer housing 200. It will be appreciated that this open end will naturally have slightly increased flexibility.

Although various latching mechanisms 500 have been disclosed herein, it will be appreciated that these are presented by way of example, and many additional possibilities as to the shape, positioning, operation, etc., of the latching mechanism 500 will be apparent to a person of ordinary skill in the art. Moreover, although the e-cigarette 10 described herein comprises three detachable sections, namely the control unit 20, cartridge 30 and vaporizer 40, it will be appreciated that other e-cigarettes may comprise a different number of sections.

In order to address various issues and advance the art, this disclosure shows by way of illustration various embodiments in which the claimed invention(s) may be practiced. The advantages and features of the disclosure are of a representative sample of embodiments only, and are not exhaustive and/or exclusive. They are presented only to assist in understanding and to teach the claimed invention(s). It is to be understood that advantages, embodiments, examples, functions, features, structures, and/or other aspects of the disclosure are not to be considered limitations on the disclosure as defined by the claims or limitations on equivalents to the claims, and that other embodiments may be utilized and modifications may be made without departing from the scope of the claims. Various embodiments may suitably comprise, consist of, or consist essentially of, various combinations of the disclosed elements, components, features, parts, steps, means, etc other than those specifically described herein. The disclosure may include other inventions not presently claimed, but which may be claimed in future.

The invention claimed is:

1. A cartridge for use in a vapor provision system, wherein the cartridge comprises:

an inner container holding a reservoir of fluid to be vaporized; and an outer housing having a mouthpiece formed therein, wherein the outer housing extends in a longitudinal direction along an outside of the inner container for at least a portion of the inner container, wherein the inner container and the outer housing are provided with a latch mechanism to retain the inner container within the outer housing, and wherein the cartridge comprises a mechanical connector for longitudinally attaching the cartridge to a control unit of the vapor provision system, wherein the latch mechanism includes a first member formed on one of the outer housing or the inner container, and a cooperating second member formed on the other of the outer housing or the inner container, and wherein the first member and the second member abut one another to engage the latch mechanism, and wherein the inner container includes a body holding the reservoir of fluid and a tab, wherein the tab allows airflow through the mouthpiece, and wherein the first member and the second member are longitudinally located adjacent to the tab.

2. The cartridge of claim 1, wherein the latch mechanism is operable independent of the relative rotational angle between the inner container and the outer housing with respect to the longitudinal direction.

3. The cartridge of claim 1, wherein the first member and the second member are located at or near an end of the inner container which is longitudinally opposite to a location of the mouthpiece.

4. The cartridge of claim 1, wherein the first member comprises a radially directed groove in an inner surface of the outer housing and the second member comprises at least one radially directed protrusion on an outer surface of the inner container.

5. The cartridge of claim 1, wherein the first member comprises a radially directed protrusion from an inner surface of the outer housing and the second member comprises at least one radially directed groove in an outer surface of the inner container.

6. The cartridge of claim 1, wherein the first member comprises a radially directed protrusion from an inner surface of the outer housing and the second member comprises at least one radially directed protrusion on an outer surface of the inner container.

7. The cartridge of claim 1, wherein at least one of the first member or the second member extends circumferentially around an axis extending in the longitudinal direction.

8. The cartridge of claim 1, wherein the first member and the second member are each provided with at least one ramp portion that slide past one another as the inner container is inserted into the outer housing prior to engagement of the latch mechanism.

9. The cartridge of claim 1, wherein a channel is provided between an inner surface of the outer housing and an outer surface of the inner container to allow vapor to flow longitudinally through the channel to the mouthpiece.

10. The cartridge of claim 9, wherein the outer housing has a substantially circular cross-section with respect to an axis extending in the longitudinal direction and the inner container has a substantially D-shaped cross-section with respect to the longitudinal direction to provide the channel.

11. The cartridge of claim 9, wherein the latch mechanism is located within the channel and is sized so as not to obstruct the channel.

12. The cartridge of claim 1, wherein at least one of the outer housing or the inner container is sufficiently flexibly resilient to support operation of the latch mechanism.

13. The cartridge of claim 1, wherein the cartridge includes a vaporizer.

14. The cartridge of claim 13, wherein the mechanical connector further provides an electrical connection for receiving electrical power from the control unit for operating the vaporizer.

15. A vapor provision system including the cartridge of claim 1.

16. A cartridge for use in a vapor provision system, wherein the cartridge comprises:

an inner container holding a reservoir of fluid to be vaporized; and an outer housing having a mouthpiece formed therein, wherein the outer housing extends in a longitudinal direction along an outside of the inner container for at least a portion of the inner container, wherein the inner container and the outer housing are provided with a latch mechanism to retain the inner container within the outer housing, and wherein a channel is provided between an inner surface of the outer housing and an outer surface of the inner container to allow vapor to flow longitudinally through the channel to the mouthpiece.

* * * * *